US006827290B2

(12) United States Patent
Zimmerman

(10) Patent No.: US 6,827,290 B2
(45) Date of Patent: Dec. 7, 2004

(54) SIDE HANDLE MIST SPRAYER

(76) Inventor: Robert P. Zimmerman, P.O. Box 150801, Altamonte Springs, FL (US) 32715

( * ) Notice: Subject to any disclaimer, the term of this patent is extended or adjusted under 35 U.S.C. 154(b) by 143 days.

(21) Appl. No.: 10/386,808

(22) Filed: Feb. 26, 2003

(65) Prior Publication Data

US 2004/0089745 A1 May 13, 2004

Related U.S. Application Data

(60) Provisional application No. 60/424,971, filed on Nov. 7, 2002.

(51) Int. Cl.[7] ..... B05B 3/02

(52) U.S. Cl. ..... 239/215; 239/222.11; 239/289; 239/333; 222/333

(58) Field of Search ..... 239/214.25, 215, 239/375, 222.11, 302, 332, 333, 383, 418, 289, 29.3, 29; 222/333, 383.2

(56) References Cited

U.S. PATENT DOCUMENTS

| | | | | | |
|---|---|---|---|---|---|
| 1,899,749 | A | * | 2/1933 | Deutsch | 239/143 |
| 3,993,250 | A | * | 11/1976 | Shure | 239/332 |
| 4,839,106 | A | | 6/1989 | Steiner | |
| D349,570 | S | | 8/1994 | Radtke, Jr. | |
| D349,954 | S | | 8/1994 | Steiner et al. | |
| 5,338,495 | A | | 8/1994 | Steiner et al. | |
| D352,775 | S | | 11/1994 | Radtke, Jr. | |
| D372,523 | S | | 8/1996 | Radtke et al. | |
| 5,613,890 | A | * | 3/1997 | DeMars | 446/15 |
| 5,620,633 | A | | 4/1997 | Junkel et al. | |
| 5,667,731 | A | | 9/1997 | Junkel et al. | |
| D386,572 | S | | 11/1997 | Radtke et al. | |
| D387,422 | S | | 12/1997 | Radtke et al. | |
| D387,852 | S | | 12/1997 | Radtke et al. | |
| 5,740,948 | A | * | 4/1998 | Chu et al. | 222/175 |
| D395,701 | S | | 6/1998 | Radtke et al. | |
| D396,104 | S | | 7/1998 | Radtke | |
| D397,427 | S | | 8/1998 | Junkel et al. | |
| D397,774 | S | | 9/1998 | Junkel et al. | |
| 5,843,344 | A | | 12/1998 | Junkel et al. | |
| 5,851,106 | A | | 12/1998 | Steiner et al. | |
| 5,897,027 | A | | 4/1999 | Steiner et al. | |
| 5,965,067 | A | | 10/1999 | Junkel et al. | |
| 6,109,874 | A | | 8/2000 | Steiner et al. | |
| D439,966 | S | | 4/2001 | Steiner | |
| 6,217,294 | B1 | | 4/2001 | Arnieri et al. | |
| 6,398,132 | B1 | * | 6/2002 | Junkel et al. | 239/289 |

* cited by examiner

*Primary Examiner*—Dinh Q. Nguyen
(74) *Attorney, Agent, or Firm*—Edward M. Livingston

(57) ABSTRACT

A side-handle mist sprayer has a mist-liquid container (3) with a side handle (1) vertically above a container base (2). A finger aperture (4) is positioned between a front container extension (5) and the side handle. A spray-trigger pump (6) having a spray trigger (7) is contained in the side handle. The spray trigger is positioned forwardly from the side handle for being finger operable with one or more fingers of a user inserted into the finger aperture for simultaneously holding the side-handle mist sprayer in a use orientation and squeezing the spray trigger to mist-pump liquid from the mist-liquid container through a mist nozzle (9) on a top-front side of the front container extension. A soft-blade fan (10) extended from a fan-power pack (11) is positioned on a front side of the front container extension. The mist nozzle is positioned to direct mist onto back sides of soft blades of the soft-blade fan for being fanned by rotation of the soft-blade fan. A shoulder strap (15) is attachable to a top of the mist-liquid container for optional lifting with a shoulder strap. A flat surface on a container bottom (21) of the mist-liquid container is provided for setting it in an upright orientation.

21 Claims, 6 Drawing Sheets

SIDE HANDLE MIST SPRAYER

CROSS-REFERENCE TO RELATED APPLICATION

This is application claims the benefit of U.S. Provisional Application No. 60/424,971, filed Nov. 7, 2002.

BACKGROUND OF THE INVENTION

This invention relates to a mist sprayer that combines a spray trigger, a side-handle container, an electrical power pack, a fan and a spray nozzle with a uniquely convenient structure.

There are a wide variety of known mist sprayers that each have unique features. None of them, however, have a trigger-spray pump on a side handle of a container which has a spray nozzle, an electric power pack and a fan that are oppositely disposed laterally from a finger-aperture for the side handle in a manner taught by this invention.

Examples of most-closely related known but different devices are described in the following patent documents:

| U.S. Pat. No. | Inventor | Issue Date |
|---|---|---|
| 5,338,495 | Steiner, et al. | Aug. 16, 1994 |
| 4,839,106 | Steiner, et al. | Jun. 13, 1989 |
| Des. 349,954 | Steiner, et al. | Aug. 23, 1994 |
| 5,897,027 | Steiner, et al. | Apr. 27, 1999 |
| 5,851,106 | Steiner, et al. | Dec. 22, 1998 |
| 6,217,294 | Arnieri, et al. | Apr. 17, 2001 |
| D 439,966 | Steiner | Apr. 03, 2001 |
| 6,109,874 | Steiner, et al. | Aug. 29, 2000 |
| 5,843,344 | Junkel, et al. | Dec. 01, 1998 |
| Des. 397,774 | Junkel, et al. | Sep. 01, 1998 |
| 5,965,067 | Junkel, et al. | Oct. 12, 1999 |
| Des. 397,427 | Junkel, et al. | Aug. 25, 1998 |
| Des. 396,104 | Radtke | Jul. 14, 1998 |
| Des. 395,701 | Radtke, et al. | Jun. 30, 1998 |
| Des. 387,852 | Radtke, et al. | Dec. 16, 1997 |
| Des. 387,422 | Radtke, et al. | Dec. 09, 1997 |
| Des. 386,572 | Radtke, et al. | Nov. 18, 1997 |
| 5,667,731 | Junkel, et al. | Sep. 16, 1997 |
| 5,620,633 | Junkel, et al. | Apr. 15, 1997 |
| Des. 372,523 | Radtke, Jr. | Aug. 06, 1996 |
| Des. 352,775 | Radtke, Jr. | Nov. 22, 1994 |
| Des. 349,570 | Radtke, Jr. | Aug. 09, 1994 |

A large plurality of prior-art utility patents in the mist-sprayer field provide convenience and efficiency nuances for different user preferences and use-conditions. A comparably large plurality of prior-art design patents describe appearances that relate variously to the convenience and efficiency nuances and user preferences.

Most of the utility and design patents describe variants of misting heads having misting triggers and fans that are attachable with helical threads to variants of bottle-like containers of misting fluid that includes water. Other prior-art utility and design patents describe misting triggers and fans that are integrated with a misting-fluid container, but not a container having a finger-aperture side handle with a pump trigger oppositely disposed laterally from a misting nozzle and fan as taught by this invention.

From the above list of examples of the prior art, the variants of misting heads attachable with helical threads to variants of bottle-like containers include: D439,966 S, U.S. Pat. Nos. 5,965,067, 5,897,027, Des. 386,572, U.S. Pat. No. 5,667,731, Des. 349,954, U.S. Pat. Nos. 5,338,495, and 4,839,106. Examples of the variants of misting triggers and fans that are integrated with containers different from the container with the finger-aperture side handle of this invention include: U.S. Pat. Nos. 6,217,294 B1, 6,109,874, 5,843,344, Des. 397,774, Des, 397,427, Des. 395,701, Des. 387,422, U.S. Pat. No. 5,620,633, Des. 372,523, and Des. 352,775.

SUMMARY OF THE INVENTION

Objects of patentable novelty and utility taught by this invention are to provide a side-handle mist sprayer which:

- is a single-unit sprayer that does not require attachment of a misting head to a separate container for use;
- has a convenient side handle with an integrated spray-trigger pump; and
- has curved edges for comfort of bodily contact.

This invention accomplishes these and other objectives with a side-handle mist sprayer having a mist-liquid container with a side handle vertically above a container base. A finger aperture is positioned between a front container extension and the side handle. A spray-trigger pump having a spray trigger is contained in the side handle. A spray trigger is positioned forwardly from the side handle for being finger operable with one or more fingers of a user inserted into the finger aperture for simultaneously holding the side-handle mist sprayer in a use orientation and squeezing the spray trigger to mist-pump liquid from the mist-liquid container through a mist nozzle on a top-front side of the front container extension. A soft-blade fan extended from a fan-power pack is positioned on a front side of the front container extension. The mist nozzle is positioned to direct mist onto back sides of soft blades of the soft-blade fan for being fanned by rotation of the soft-blade fan. A shoulder strap is attachable to a top of the mist-liquid container for optional lifting with a shoulder strap. A flat surface on a bottom of the mist-liquid container is provided for setting it in an upright orientation.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to a description of preferred embodiments with reference to the following drawings which are explained briefly as follows:

DESCRIPTION OF PREFERRED EMBODIMENT

Listed numerically below with reference to the drawings are terms used to describe features of this invention. These terms and numbers assigned to them designate the same features throughout this description.

Figure 1:
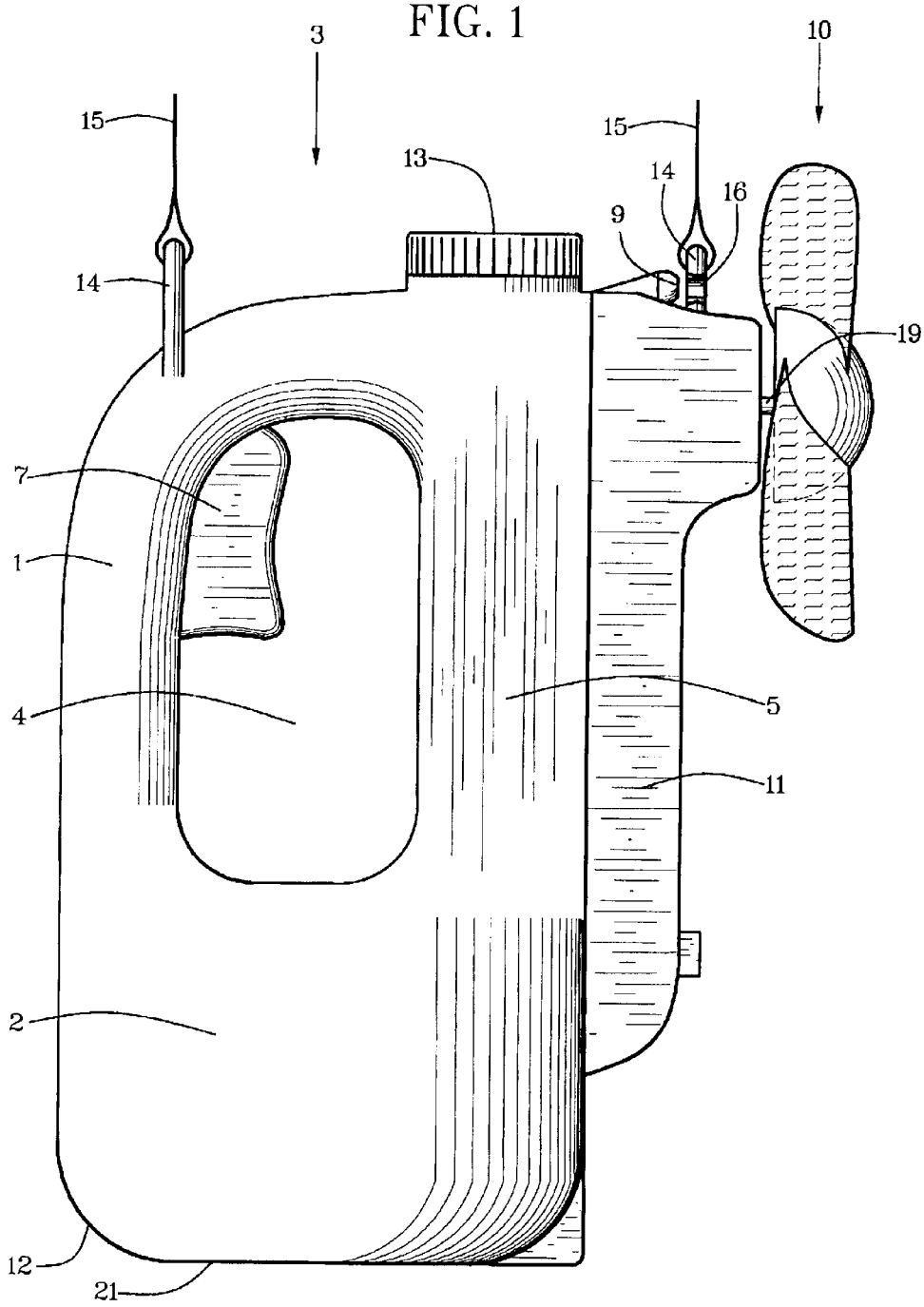
FIG. 1 is a partially cutaway side elevation view of an embodiment of the side-handle mist sprayer having a battery power pack.

1. Side handle
2. Container base
3. Mist-liquid container
4. Finger aperture
5. Front container extension
6. Spray-trigger pump
7. Spray trigger
8. Liquid
9. Mist nozzle
10. Soft-blade fan
11. Fan-power pack
12. Curved edges
13. Top lid
14. Shoulder-strap attachments
15. Shoulder straps
16. Mist orifice
17. Battery chamber
18. Fan motor
19. Fan-motor shaft
20. Outlet-power reducer
21. Container bottom
22. Inlet valve
23. Outlet valve
24. Plunger cylinder
25. Nozzle tube
26. Container tube
27. Collar tube
28. Container throat Referring to FIGS. 1–3, a side-handle mist sprayer includes a side handle 1 vertically above a side of a container base 2 of a mist-liquid container 3. A finger aperture 4 is provided for inserting fingers of a hand intermediate the side handle 1 and a front container extension 5 that is extended upwardly from an opposite side of the container base 2 from the side handle 1.

A spray-trigger pump 6 having a spray trigger 7 is positioned in the side handle 1. The spray trigger 7 is positioned on an aperture side of the side handle 1 for being squeezed in a direction of the side handle 1 by at least one user's finger for pumping liquid 8 from the mist-liquid container 3 through a mist nozzle 9 on an outside of the front container extension 5.

A soft-blade fan 10 is extended from a fan-power pack 11 positioned on a front side of the outside of the front container extension 5. The front side !of the outside of the front container extension 5 is oppositely disposed from the side handle 1 on the mist-liquid container 3.

The mist nozzle 9 is positioned to direct mist onto back sides of soft blades of the soft-blade fan 10.

The mist-liquid container 3 includes curved edges 12 for comfortable contact with a user.

The front container extension 5 includes a top lid 13 intermediate a top of the fan-power pack 11 and a top of the side handle 1.

Shoulder-strap attachments 14 can be positioned on a top of the mist-liquid container 3 for use of shoulder straps 15 for which only attachments ends are shown. A front shoulder-strap attachment 14 can have a mist orifice 16 for allowing communication of mist from the mist nozzle 9 to the soft-blade fan 10 from a position closer to the top lid 13.

Figure 2:
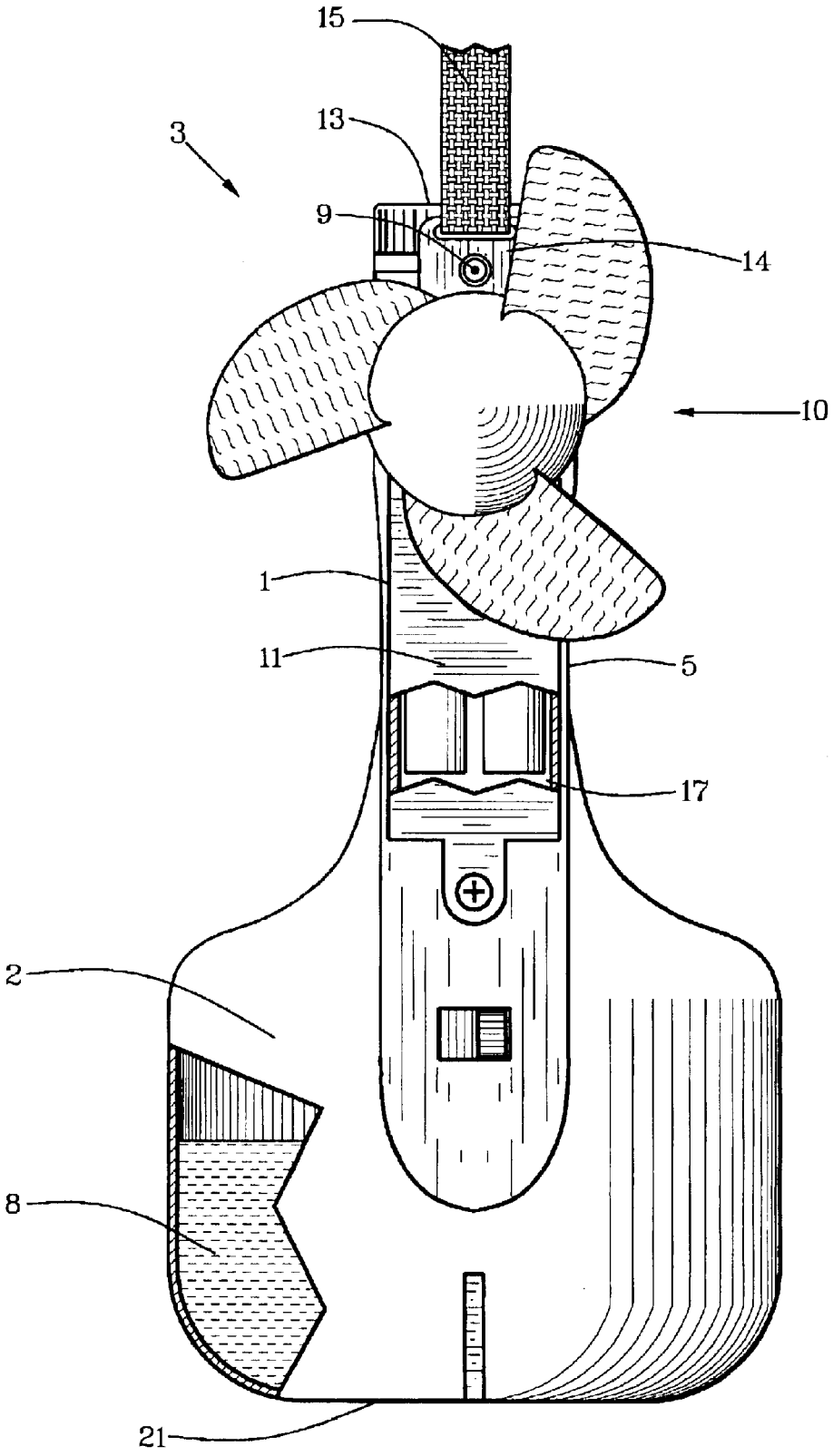
FIG. 2 is a partially cutaway front elevation view of the FIG. 1 illustration.
Figure 3:
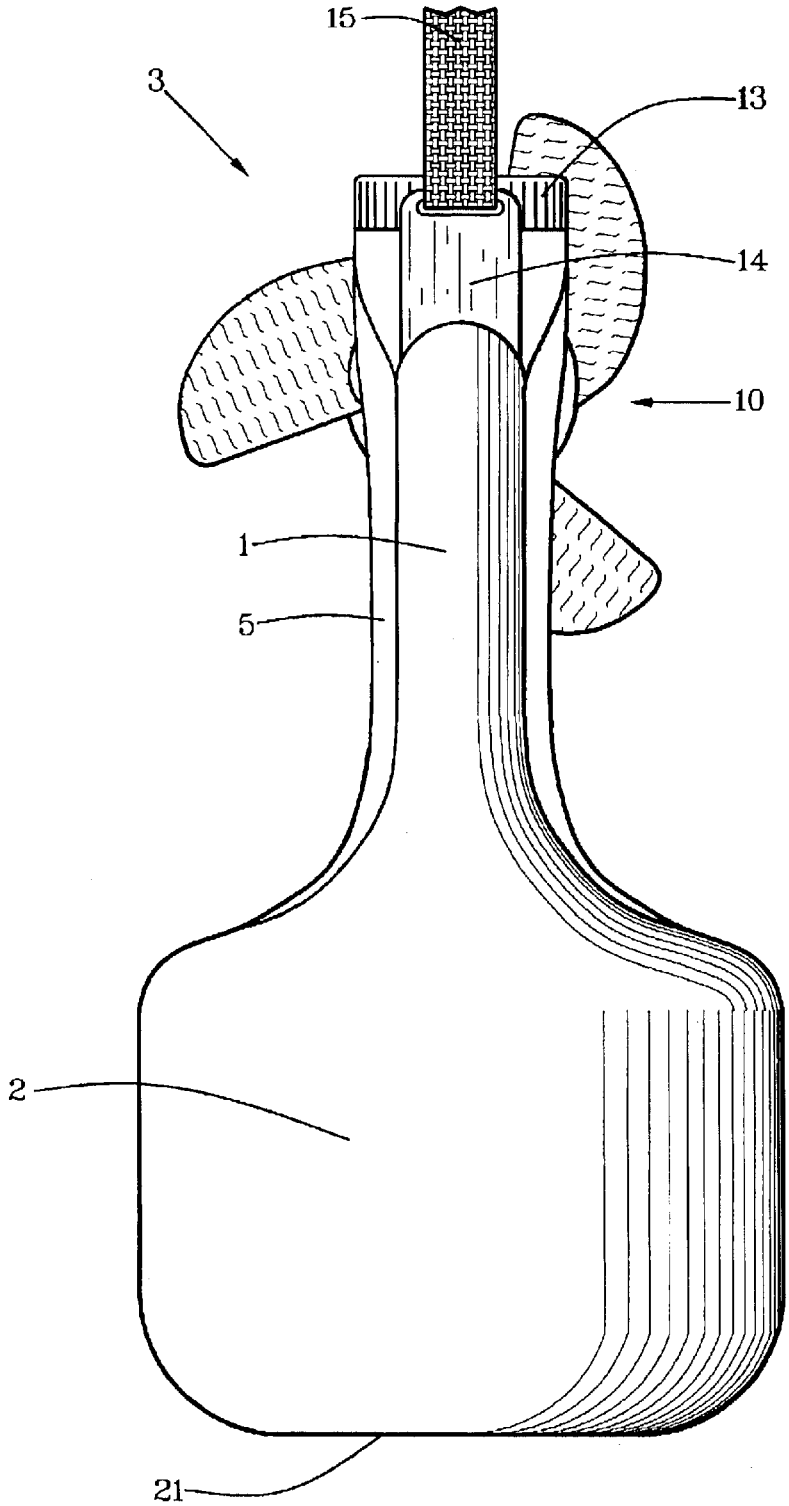
FIG. 3 is a partially cutaway rear elevation view of the FIG. 2 illustration.
Figure 4:
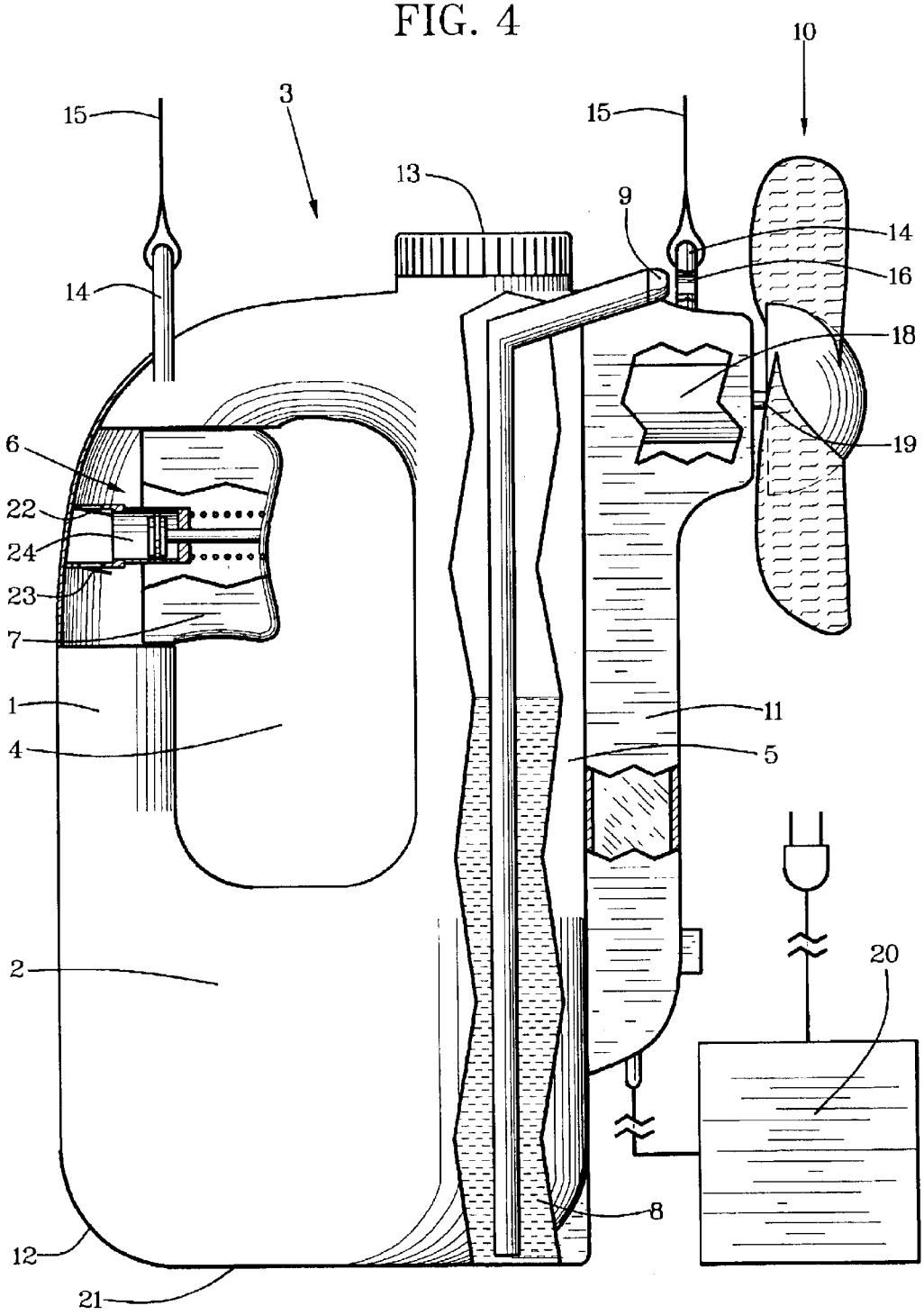
FIG. 4 is a partially cutaway side elevation view of an embodiment of the side-handle mist sprayer having a wall-outlet power pack and a container-pressured spray nozzle.

The fan-power pack 11 can include electrical communication from a battery chamber 17 shown in FIG. 2 to a fan motor 18, shown in FIG. 4, having a: fan-motor shaft 19 to which the soft-blade fan 10 is attached.

Referring to FIG. 4, the fan-power pack 11 can include electrical communication to the fan motor 18 from an outlet-power reducer 20 for operation or recharging batteries from an 110 volt AC outlet or ultimately, a DC outlet, such as, a vehicle cigarette lighter.

The mist-liquid container 3 includes a container bottom 21 that is about perpendicular to the front container extension 5. The container bottom 21 includes a surface area that is predetermined in proportion to a cross-sectional area of a major-area portion of a bottom portion of the mist-liquid container 3.

Figure 5:
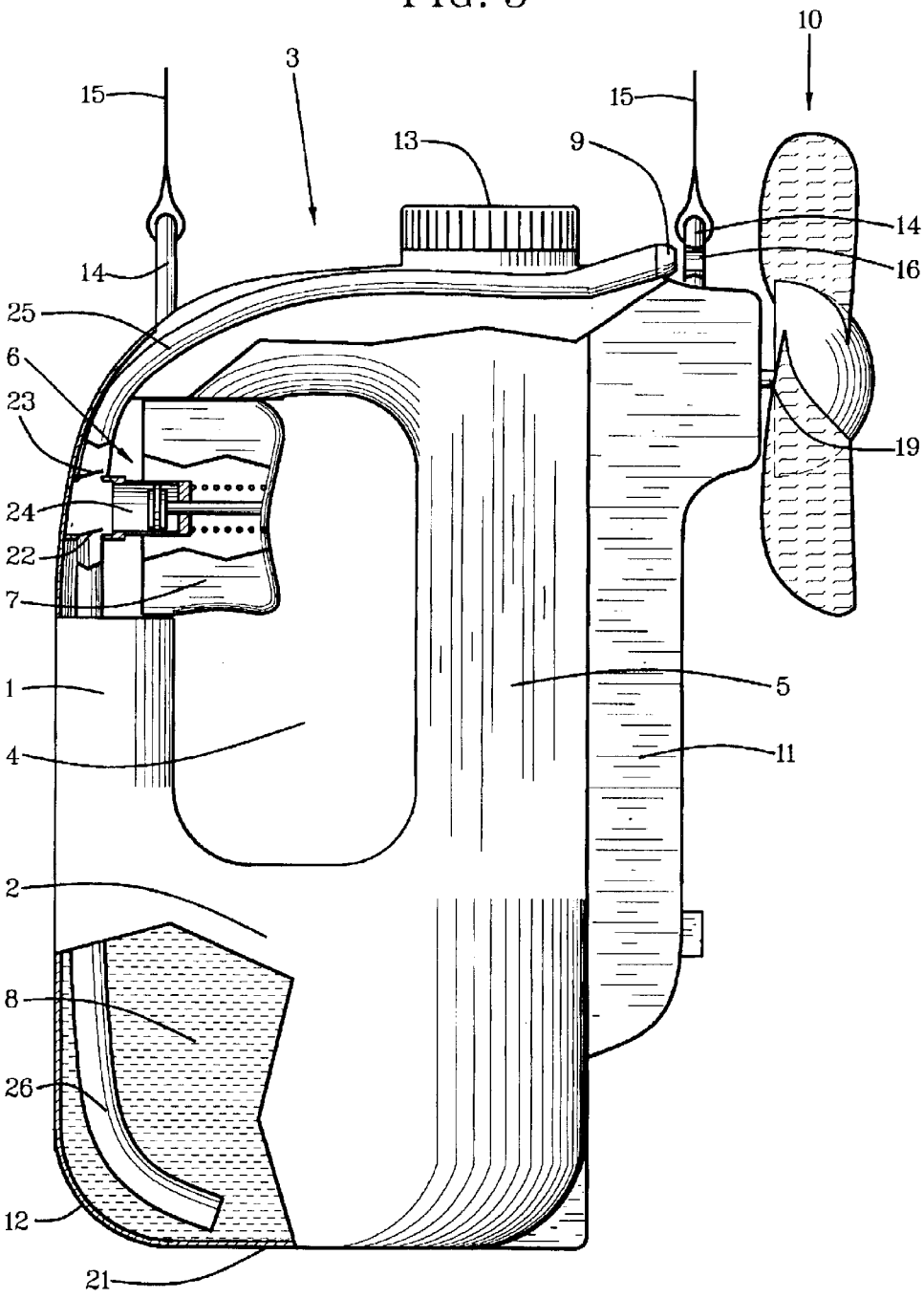
FIG. 5 is a partially cutaway side elevation view of an embodiment of the side-handle mist sprayer having the battery power pack and a tube-pressured spray nozzle with a nozzle tube in fluid communication from the spray-trigger pump to the mist nozzle.

The mist-liquid container 3 can include a pressure-tight lid which can be the top lid 13 for containing fluid pressure in the mist-liquid container from pressure of the spray-trigger pump 6 that is optionally a container-pressurization pump. The spray-trigger pump 6 can include an inlet valve 22 and outlet valve 23 that direct pressure from a plunger cylinder 24 to the mist-liquid container 3 for a container pressurization pump as shown in FIG. 4. Optionally, as shown in FIG. 5, the inlet valve 22 and the outlet valve 23 can direct pressure from the plunger cylinder 24 to a nozzle tube 25 from a container tube 26.

Figures 6, 7:
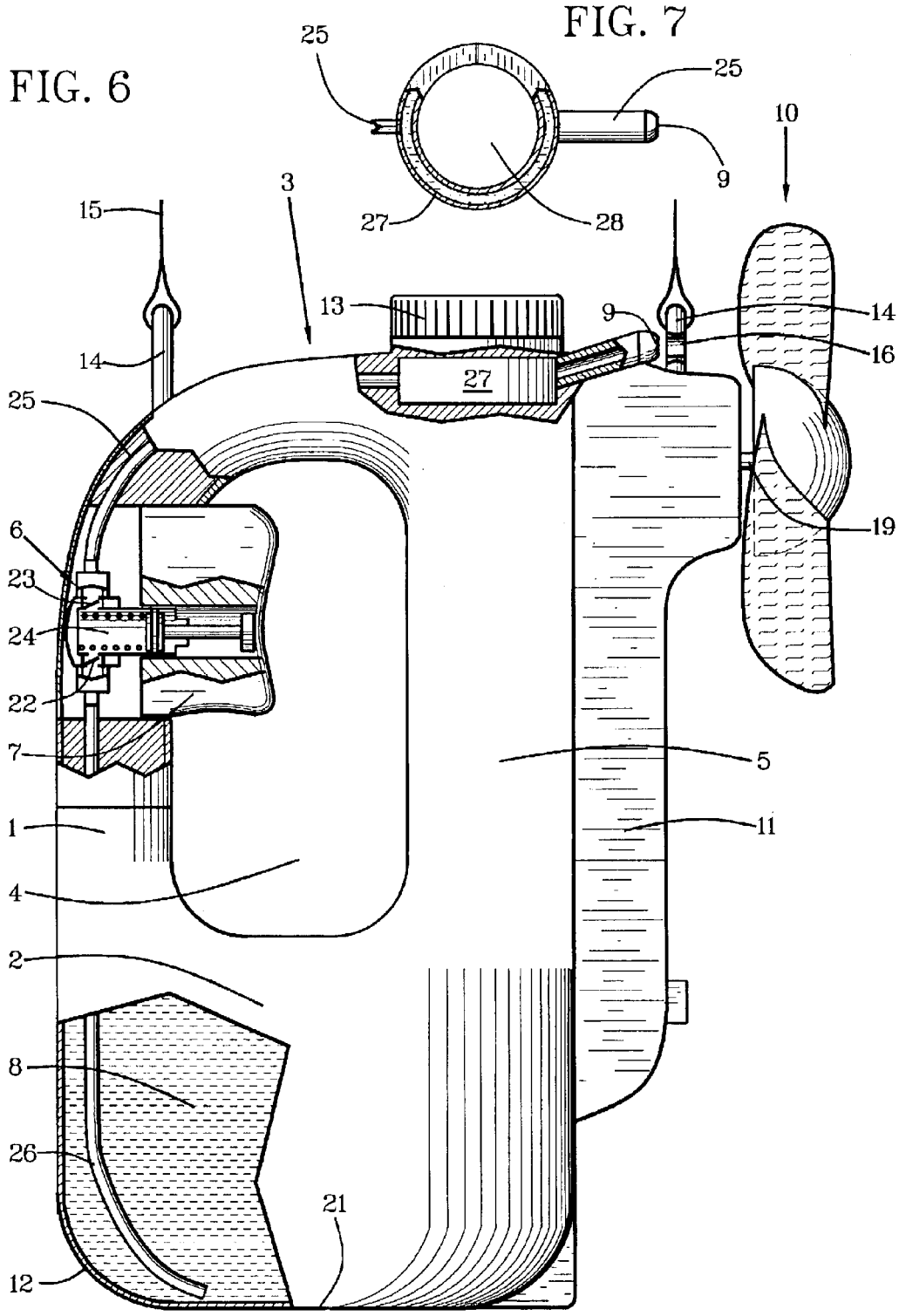
FIG. 6 is a partially cutaway side elevation view of an embodiment of the side-handle mist sprayer having a tube-pressured spray nozzle with a nozzle tube in fluid communication from the spray-trigger pump to a collar tube in route to the mist nozzle.
FIG. 7 is a partially cutaway top view of the collar tube of the FIG. 6 illustration.

Referring to FIGS. 6–7, the spray-trigger pump 6 can include a collar tube 27 that encompasses a container throat 28 that is in fluid communication to the container base 2 through the front container extension 5 for providing unrestricted passage through the container throat 28 by tubular communication from the nozzle tube 25 to the mist nozzle 9.

A new and useful side-handle mist sprayer having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A side-handle mist sprayer comprising:

a side handle vertically above a side of a container base of a mist-liquid container;

a finger aperture intermediate the side handle and a front container extension that is extended upwardly from an opposite side of the container base from the side handle;

a spray-trigger pump having a spray trigger positioned in the side handle;

the spray trigger being positioned on an aperture side of the side handle for being squeezed in a direction of the side handle by at least one user's finger for pumping liquid from the mist-liquid container through a mist nozzle on an outside of the front container extension;

a soft-blade fan extended from a fan-power pack positioned on a front side of the outside of the front container extension;

the front side of the outside of the front container extension being oppositely disposed from the side handle on the mist-liquid container; and the mist nozzle being positioned to direct mist onto back sides of soft blades of the soft-blade fan.

2. The side-handle mist sprayer of claim 1 wherein:

the mist-liquid container includes curved edges for comfortable contact with a user.

3. The side-handle mist sprayer of claim 1 wherein:

the front container extension includes a top lid intermediate a top of the fan-power pack and a top of the side handle.

4. The side-handle mist sprayer of claim 1 and further comprising:

shoulder-strap attachments on a top of the mist-liquid container.

5. The side-handle mist sprayer of claim 1 wherein:

the fan-power pack includes electrical communication from a battery chamber to a fan motor having a fan-motor shaft to which the soft-blade fan is attached.

6. The side-handle mist sprayer of claim 1 wherein:

the fan-power pack includes reduced-power communication to the fan motor from an outlet-power reducer.

7. The side-handle mist sprayer of claim 1 wherein:

the mist-liquid container includes a container bottom that is about perpendicular to the front container extension.

8. The side-handle mist sprayer of claim 7 wherein:

the container bottom includes a surface area that is predetermined in proportion to a cross-sectional area of a major-area portion of a bottom portion of the mist-liquid container.

9. The side-handle mist sprayer of claim 1 wherein:

the mist-liquid container includes a pressure-tight lid for containing fluid pressure in the mist-liquid container from pressure of the spray-trigger pump that is optionally a container-pressurization pump.

10. The side-handle mist sprayer of claim 1 wherein:

the spray-trigger pump includes a container-pressurization pump.

11. The side-handle mist sprayer of claim 1 wherein:

the spray-trigger pump includes a nozzle-tube pump.

12. The side-handle mist sprayer of claim 11 wherein:

the nozzle-tube pump includes a collar tube;

the collar tube encompasses a container throat; and the container throat is in fluid communication to the container base through the front container extension for providing unrestricted passage through the container throat by tubular communication from the nozzle tube to the mist nozzle.

13. A side-handle mist sprayer comprising:

a side handle vertically above a side of a container base of a mist-liquid container;

a finger aperture intermediate the side handle and a front container extension that is extended upwardly from an opposite side of the container base from the side handle;

a spray-trigger pump having a spray trigger positioned in the side handle;

the spray trigger being positioned on an aperture side of the side handle for being squeezed in a direction of the side handle by at least one user's finger for pumping liquid from the mist-liquid container through a mist nozzle on an outside of the front container extension;

a soft-blade fan extended from a fan-power pack positioned on a front side of the outside of the front container extension;

the front side of the outside of the front container extension being oppositely disposed from the side handle on the mist-liquid container;

the mist nozzle being positioned to direct mist onto back sides of soft blades of the soft-blade fan the mist-liquid container includes curved edges for comfortable contact with a user;

the front container extension includes a top lid intermediate a top of the fan-power pack and a top of the side handle; and the top of the mist-liquid container includes shoulder-strap attachments.

14. The side-handle mist sprayer of claim 13 wherein:

the fan-power pack includes electrical communication from a battery chamber to a fan motor having a fan-motor shaft to which the soft-blade fan is attached.

15. The side-handle mist sprayer of claim 13 wherein:

the fan-power pack includes reduced-power communication to the fan motor from an outlet-power reducer.

16. The side-handle mist sprayer of claim 13 wherein:

the mist-liquid container includes a container bottom that is about perpendicular to the front container extension.

17. The side-handle mist sprayer of claim 16 wherein:

the container bottom includes a surface area that is predetermined in proportion to a cross-sectional area of a major-area portion of a bottom portion of the mist-liquid container.

18. The side-handle mist sprayer of claim 13 wherein:

the mist-liquid container includes a pressure-tight lid for containing fluid pressure in the mist-liquid container from pressure of the spray-trigger pump that is optionally a container-pressurization pump.

19. The side-handle mist sprayer of claim 13 wherein:

the spray-trigger pump includes a container-pressurization pump.

20. The side-handle mist sprayer of claim 13 wherein:

the spray-trigger pump includes a nozzle-tube pump.

21. The side-handle mist sprayer of claim 20 wherein:

the nozzle-tube pump includes a collar tube;

the collar tube encompasses a container throat; and the container throat is in fluid communication to the container base through the front container extension for providing unrestricted passage through the container throat by tubular communication from the nozzle tube to the mist nozzle.

* * * * *